US006400079B1

(12) United States Patent
Baret et al.

(10) Patent No.: US 6,400,079 B1
(45) Date of Patent: Jun. 4, 2002

(54) PLASMA PANEL WITH CELL CONDITIONING EFFECT

(75) Inventors: Guy Baret, Grenoble; Agide Moi, Seyssins, both of (FR)

(73) Assignee: Thomson Licensing, S.A., Boulogne Cedex (FR)

( * ) Notice: Subject to any disclaimer, the term of this patent is extended or adjusted under 35 U.S.C. 154(b) by 0 days.

(21) Appl. No.: 09/445,338

(22) PCT Filed: Jun. 5, 1998

(86) PCT No.: PCT/FR98/01153

§ 371 (c)(1),
(2), (4) Date: Feb. 18, 2000

(87) PCT Pub. No.: WO98/57347

PCT Pub. Date: Dec. 17, 1998

(30) Foreign Application Priority Data

Jun. 10, 1997 (FR) ..... 97 07181

(51) Int. Cl.[7] ..... H01J 17/49
(52) U.S. Cl. ..... 313/582; 313/292
(58) Field of Search ..... 313/582–587, 313/292; 345/37, 41, 60

(56) References Cited

U.S. PATENT DOCUMENTS 5,684,362 A 11/1997 Togawa ..... 313/582
6,100,946 A * 8/2000 Buzak et al. ..... 313/582 X

FOREIGN PATENT DOCUMENTS

| | | | |
|---|---|---|---|
| EP | 0135382 | 3/1985 | ..... H01J/17/49 |
| FR | 2417848 | 9/1979 | ..... H01J/17/36 |
| JP | 6-208109 | 7/1994 | ..... H01J/17/490 |

* cited by examiner

*Primary Examiner*—Ashok Patel
(74) *Attorney, Agent, or Firm*—Joseph S. Tripoli; Dennis H. Irlbeck; Carlos M. Herrera

(57) ABSTRACT

A plasma panel includes a front faceplate and a rear faceplate between which are constituted cells. The two faceplates are assembled together by bracing means which determine the distance between the two faceplates. The plasma panel further includes barriers arranged between the two faceplates, and serving in particular to prevent the discharges of one cell from extending to the other neighboring cells. The invention is characterized in that the height of the barriers is less than the distance between the faceplates. This arrangement provides a conditioning effect to the cells to thereby enabling them to be activated more speedily. The invention is in particular applicable to plasma panels using luminophores of different colours.

7 Claims, 2 Drawing Sheets

PLASMA PANEL WITH CELL CONDITIONING EFFECT

FIELD OF THE INVENTION

The invention relates to the plasma display panels, and more particularly to means enabling a so-called "cell conditioning" effect to be obtained.

BACKGROUND

Plasma panels (abbreviated to "PP" in the rest of this description) are image display screens of the "flat screen" type. There are two main families of PPs: PPs whose operation is of the continuous type, and those whose operation is of the alternative type. All PPs operate using the principle of an electrical discharge in a gas that results in emission of light. They generally include two insulating sheets, each carrying one or more networks of electrodes, the space between the sheets being gas-filled. The sheets are assembled together such that their networks of electrodes are mutually orthogonal. Each intersection of electrodes defines a cell which corresponds to a gas space.

FIG. 1 represents by way of example, in a partial and simplified manner, a classic structure of a color alternative PP. Various types of alternative PPs are found, among which we can mention for example: those of the type using only two crossed electrodes to define and control a cell, as described notably in a French patent published under the number 2,417,848, and those of the so-called "coplanar structure" type whose structure and operation are described for example in the European patent EP-A-0.135.382. Alternative PPs have a common characteristic in that they have an internal memory effect during operation, owing to the fact that their electrodes are covered by layer of dielectric which isolates them from the gas, in other words from the discharge.

In the example of FIG. 1, the PP is of the type having two crossed electrodes defining a cell. It is composed of two substrates or sheets 2, 3, of which one is a front sheet 2, i.e. the sheet that is on the same side as an observer (not shown); this sheet carries a first network of electrodes called "line electrodes", of which only 3 electrodes Y1, Y2, Y3 are shown. The line electrodes Y1 to Y3 are covered with a layer 5 of a dielectric material.

The second sheet 3 forms the rear sheet. It is on the opposite side from the observer and consequently is preferably equipped with components whose function is to prevent the transmission of light towards the observer; it carries a second network of electrodes called "column electrodes", of which only 5 electrodes X1 to X5 are shown in FIG. 1. The two sheets 2, 3, are of a same material, generally glass. These two sheets 2, 3 are destined to be assembled together such that the networks of line and column electrodes are mutually orthogonal.

On the rear sheet 3, the column electrodes X1 to X5 are also covered with a layer 6 of dielectric material. The dielectric layer 6 is itself covered with layers forming bands 7, 8, 9 of luminiferous materials that correspond for example to the colors green, red and blue respectively. The luminiferous bands 7, 8, 9 are placed parallel to and above the column electrodes X1 to X5 from which they are separated by the dielectric layer 6. The rear sheet 3 also includes barriers 11, parallel to the luminiferous bands 7, 8, 9 and placed between them.

The PP is formed by the assembly of the front and rear sheets 2, 3, this operation forming a matrix of cells C1 to Cn.

The cells are defined at each intersection between a line electrode Y1 to Y3 and a column electrode X1 to X5. Each cell has a discharge zone whose section corresponds substantially to so-called "useful" areas formed by the surfaces facing the two crossed electrodes. For each cell, the gas discharge causes electric charges that, in the case of an "alternative" PP, cumulate on the dielectric 5, 6 facing the line and column electrodes; in the example shown here, this is obtained at the rear sheet 3 by means of cavities Ep1 to Epn made in the luminiferous bands 7, 8, 9 substantially opposite the useful areas of the column electrodes X1 to X5.

In the example shown, the intersections made by the first line electrode Y1 with the column electrodes X1 to X5 defines a line of cells, each cell being in the form of a cavity: the first cell C1 is located at the first cavity Ep1, the second cell C2 at the second cavity Ep2, and so on until the fifth cavity Ep5 constituting a fifth cell C5. The first, second and third cavities Ep1, Ep2, Ep3 are respectively located in green 7, red 8 and blue 9 luminiferous bands; they correspond to monochromic cells of three different colors which together can constitute a three-color cell.

The quality of the discharges in each cell, for a given value of the tension applied to the electrodes, depends on the geometry and dimensions of the cells, and the overall quality of the operation of the PP requires that these characteristics must be reproduced with low dispersion for all the cells of the PP. One of these characteristics that is particularly important is the height of the gas space formed between the front and rear sheets 2, 3, when these are assembled.

Generally, in color PPs (which, unlike with monochrome PPs, have luminiferous components enabling them to produce lights of different colors), one of the dimensions of the gas space formed between the sheets 2, 3 corresponds to the distance between these sheets, this distance being defined by the height H1 of the barriers 11; in the rest of this description, these barriers are referred to as "carrier barriers". During assembly of the two sheets 2, 3, they are separated from each other by the carrier barriers 11 that therefore play the role of spacers.

Since the carrier barriers 11 have the same height H1 as the space separating the sheets 2, 3, they constitute relatively tight partitions, so that in addition to their spacing function mentioned earlier they assure another function known as "confinement". This well-known confinement function consists notably of confining the discharge, in other words preventing its propagation into non-addressed neighboring cells, and thereby avoiding diaphonic effects between cells, and of preventing the ultraviolet radiation created by a discharge in a given cell from exciting the luminiferous material in adjacent cells, which would lead to lack of saturation of the colors, this phenomenon being known as a diaphoty effect. We note in the example shown in FIG. 1, that since the carrier barriers 11 are placed so as separate two luminiferous bands 7, 8, 9 of different colors in a so-called "triad" arrangement, they assure these confinement functions only between cells situated along the same line electrode Y1 to Y3, as for cells C1 to C5.

However the authors of the invention have observed that excessive confinement of cells can in some cases adversely affect the operation of the PP, especially when high speed triggering or inscription of the cells is necessary, as for example in the case of television images. The authors realize that a structure such as the one shown in FIG. 1, leads to total confinement of the cells, in other words to total isolation between two adjacent cells of different colors, and that this total confinement may deprive these cells of the benefits of phenomena of transfer, from one cell to another, of charges (ions or electrons of the plasma) and/or ultraviolet photons that can contribute to the triggering of a discharge in the gas.

Such transfer phenomena produce an effect known as "cell conditioning", which can occur only if the structure of the cells leaves a path in the gas-filled space between neighboring cells, and in both directions, in other words along the line electrodes and along the column electrodes. Total confinement of a cell with respect to its two neighboring cells of different colors prevents this conditioning effect and reduces the cell activation speed.

The present invention proposes simple means of assuring in a PP the confinement and cell conditioning functions mentioned above, but without adversely affecting the constancy of the spacing between the two sheets of the PP. The invention achieves this notably by separating the sheet spacing function from the cell confinement function, in order to be able to modulate the action of the means of confinement.

SUMMARY OF THE INVENTION

The invention is therefore a plasma display panel comprising two parallel sheets assembled one on top of the other, at least two networks of electrodes defining cells, means of spacing defining a spacing distance between the sheets, and means of confinement of the cells, characterized in that the means of confinement are barriers whose height is perpendicular to the sheets, said height being less than the spacing distance between the sheets.

BRIEF DESCRIPTION OF THE DRAWINGS

The present invention will be better understood on reading the description below of an embodiment, taken only as a non-limitative example, with reference to the appended drawings, in which.

DETAILED DESCRIPTION

Figure 1:
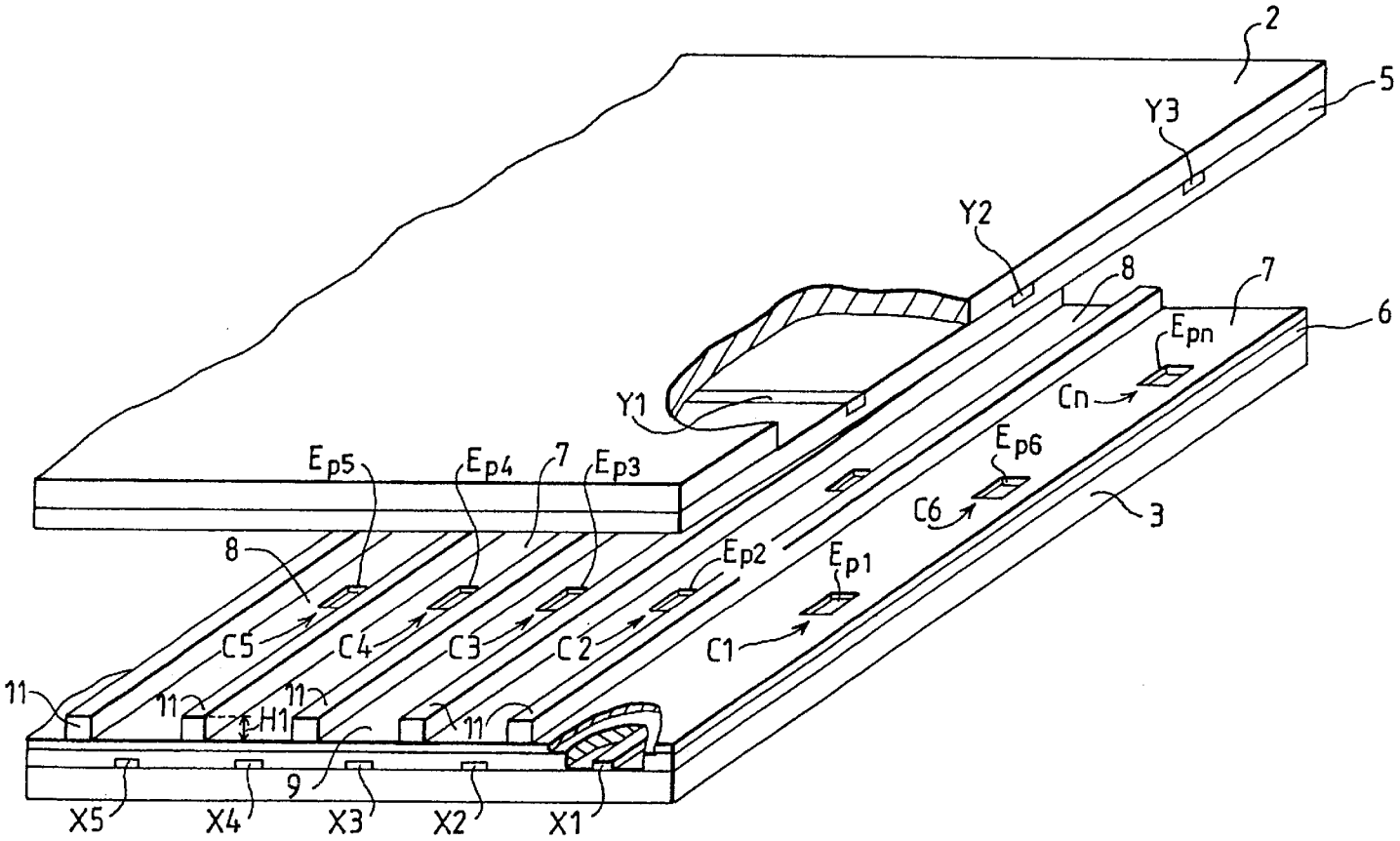
FIG. 1 (PRIOR ART)
FIG. 1, already described, represents a structure of color plasma display panel according to the prior art.
Figure 2:
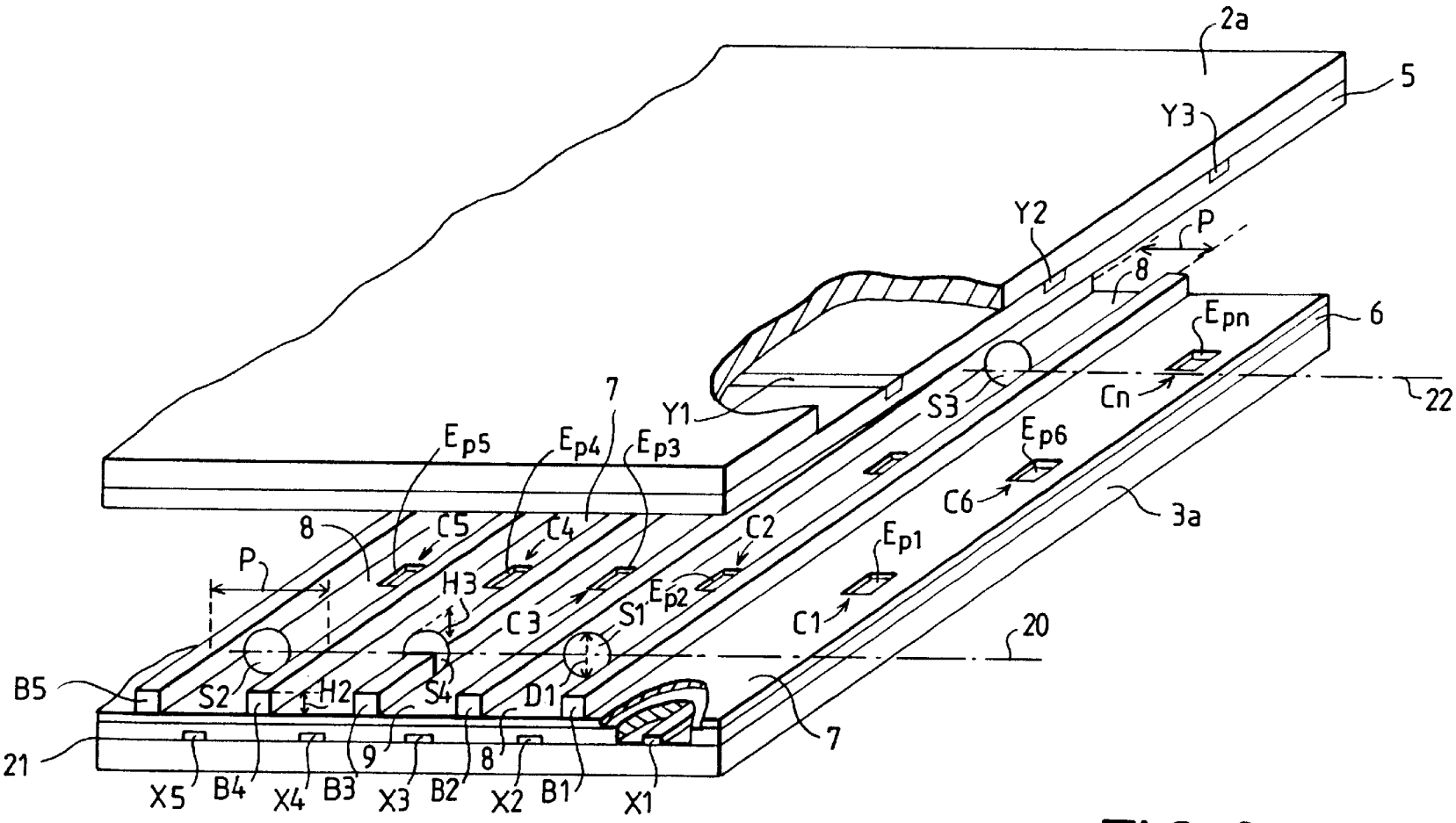
FIG. 2 represents a color plasma display panel according to the invention.

FIG. 2 represents a simplified view, similar to that of FIG. 1, of a plasma panel according to the invention, including a front sheet 2*a* and a rear sheet 3*a*. In the non-limitative embodiment shown, the PP according to the invention is of a type similar to that of FIG. 1: in fact, in the embodiment the front sheet 2*a* is identical to the front face 2 of FIG. 1; the only differences between the invention and the prior art relate to the rear face 3*a* and concern the means of spacing and the means of confinement.

The rear sheet 3*a* includes, in the same manner as the rear sheet 3 of FIG. 1, column electrodes X1 to X5 covered with a dielectric layer 6, itself covered by luminiferous elements in the form of successive bands 7, 8, 9; as for the rear face 3 of the panel in FIG. 1, these bands 7, 8, 9 are parallel to the column electrodes X1 to X5 and include cavities Ep1 to Epn each constituting a cell C1 to Cn.

According to a characteristic of the invention, the means of spacing determining the spacing distance between the two sheets 2*a* and 3*a* is constituted by a network of balls or spheres of which only four balls S1, S2, S3, S4 are shown in FIG. 2. During the assembly of the front and rear sheets 2*a*, 3*a*, these two sheets are held against each other by the spacing balls S1 to S4, such that the spacing distance between these sheets 2*a*, 3*a* is determined by the diameter D1 of the balls. The balls S1 to S4 are of course made from an electrically non-conducting material, glass or sapphire for example; we note that balls of the diameters required for this application (of the order 150 microns, for example) are commonly used in industry.

According to another characteristic of the invention, the confinement of cells C1 to Cn is obtained in a more limited manner than in the prior art, by means of confinement barriers B1, B2, . . . , B5 whose height H2 is less than the spacing distance of the sheets, in other words by the diameter D1 of the spacing balls S1 to S4. The confinement barriers B1 to B5 are placed in the same manner as the carrier barriers 11 of FIG. 1, in other words parallel to the column electrodes X1 to X5, so as to separate two contiguous luminiferous bands 7, 8, 9, having different colors. The barriers can then assure confinement functions (as explained previously), in other words partially or completely blocking the propagation of discharges between neighboring cells, and providing sufficient isolation to isolate optically a cell from the radiation emitted by neighboring cells of different colors.

The barriers B1 to B5 must have for this reason a height H2 sufficient to assure this confinement, while leaving between the summit of these barriers B1 to B5 and the front sheet 2*a* a space sufficient to enable the exchanges between neighboring cells that provide for the cell conditioning effect already explained. This space required for the conditioning effect corresponds to a height H3, given by the difference between the diameter D1 of the balls S1 to S4 and the height H2 of the confinement barriers B1 to B5. The height H3 of the free path between the barriers B1 to B5 and the front sheet 2*a* can vary according to the technological conditions specific to the PP, and can be determined by trial and error. However, tests reveal that in a many cases, good operation is obtained by fixing the height H2 of the confinement barriers B1 to B5 at about 65% to 85% of the diameter D1 of the balls S1 to S4.

We note that the same configuration of the confinement barriers could also be adopted for another network of confinement barriers (not shown), these barriers on the other network running perpendicular to the barriers B1 to B5, so as to form a matrix of crossing barriers.

In the non-limitative embodiment shown in FIG. 2, the first and second balls S1, S2 are placed respectively between the first and second barriers B1, B2, and between the fourth and fifth barriers B4, B5; these two balls S1, S2 are placed along an axis 20 perpendicular to the confinement barriers B1 to B5 and located substantially midway between an edge 21 of the sheet 3*a* and the cavities Ep1 to Ep5. As illustrated by a third ball S3, other spacing balls can be placed along for example a second axis 22 parallel to the first axis 20 and located between the cavities Ep6 and Epn. The spacing balls can of course be arranged differently, the number and distribution of these balls on the surface of a sheet 2*a*, 3*a* taking account, for example, of the admissible tolerance on the value of the separation D1 between the two sheets; the important point is of course that the balls be placed between the cells but not at the precise location of a cell, in order not to affect the discharge.

We note that it is preferable (though not obligatorily) that the confinement barriers B1 to B5 be fixed to the sheet carrying the luminiferous material (the rear sheet 3*a* in the example of FIG. 2), so as to leave a space H3 between their summit and the other sheet.

This structure with confinement barriers of height less than the spacing distance of the sheets enables a vacuum to be formed in the panel much more quickly, which is an appreciable advantage in an industrial fabrication process.

The confinement barriers B1 to B5 can be made using a classic method, similar to that used for the carrier barriers 11 shown in FIG. 1: they are then made of an electrically non-conducting material that can withstand a crushing pressure, such as glass, enamel or ceramic. According to another characteristic of the invention, the confinement barriers B1 to B5 can also be made of a "soft" material which crushes under the influence of pressure, notably that exerted by the balls S1 to S4. In this case, the confinement barriers B1 to B5 can be constituted for example by a friable deposit of alumina or silica powder.

During fabrication, we can proceed in one of two ways: either placing the network of balls S1 to S4 on one of the sheets 2*a*, 3*a* and placing the confinement barriers B1 to B5 on the other sheet; the advantage of using barriers B1 to B5 of "soft" type is that during the assembly of the front and rear sheets 2*a*, 3*a*, if any ball finds itself facing a barrier it can press into the barrier without destroying it, as illustrated in FIG. 2 where we see the ball S4 penetrating a confinement barrier B3. We note that the balls can be held in place until the assembly of the sheets is finished, for example by a gluing resulting from heating the sheet;

or placing the network of balls S1 to S4 on the same sheet 3*a* as the confinement barriers B1 to B5: in this case, the balls can be more easily placed between these barriers.

In both cases, "soft" type barriers that can crush to allow one or more balls to penetrate them, offer the advantage of requiring less precision in the positioning of the network of balls and the network of barriers B1 to B5, and in the relative positioning of the two sheets.

The description of the invention has been given with reference to a "color" plasma display panel, but it is obvious that the invention can also be advantageously applied to all types of plasma panels for which the effect of cell confinement needs to be limited.

What is claimed is:

1. Plasma panel comprising:

two parallel sheets assembled one on top of the other, each carrying at least one network of electrodes defining cells, these sheets being spaced apart and delimiting a space filled with gas;

means of spacing whose height is equal to the distance between the sheets;

means of confinement of the cells wherein the means of confinement of the cells are constituted by at least one network of confinement barriers whose height perpendicular to the sheets is less than the spacing distance between the sheets, the means of spacing being placed between tow confinement barriers; and at least two types of luminiferous elements corresponding to different colors.

2. Plasma panel according to claim 1, wherein the two luminiferous elements of different colors are separated by a confinement barrier.

3. Plasma panel according to claim 1, wherein the luminiferous elements form bands that run parallel to the electrodes of one of the networks of electrodes.

4. Plasma panel according to claim 1, wherein one of the two sheets is a so-called "front sheet" and the other is a so-called "rear sheet" carrying the luminiferous elements and the column electrodes.

5. Plasma panel according to claim 1, wherein the confinement barriers are fixed to the one of the two sheets that also carries the luminiferous elements.

6. Plasma panel according to claim 1, wherein the confinement barriers are barriers of "soft" type made from a material that can be crushed under the influence of pressure exerted by the means of spacing.

7. Plasma panel according to claim 1, wherein at least one of the means of spacing is placed between two cells.

* * * * *